US009815594B2

(12) United States Patent
Brodeur

(10) Patent No.: US 9,815,594 B2
(45) Date of Patent: Nov. 14, 2017

(54) TANK FOR ELECTRICAL EQUIPMENT

(71) Applicant: ABB Technology AG, Zurich (CH)

(72) Inventor: Samuel Brodeur, Saint-Bruno-de-Montarville (CA)

(73) Assignee: ABB Schweiz AG (CH)

( * ) Notice: Subject to any disclaimer, the term of this patent is extended or adjusted under 35 U.S.C. 154(b) by 276 days.

(21) Appl. No.: 14/515,150

(22) Filed: Oct. 15, 2014

(65) Prior Publication Data

US 2016/0107795 A1 Apr. 21, 2016

(51) Int. Cl.

| | |
|---|---|
| ***H01F 27/10*** | (2006.01) |
| ***H01F 27/06*** | (2006.01) |
| ***H01F 27/02*** | (2006.01) |
| ***H01F 27/00*** | (2006.01) |
| ***B65D 25/20*** | (2006.01) |
| ***B65D 85/00*** | (2006.01) |

(52) U.S. Cl.

CPC ..... *B65D 25/20* (2013.01); *B65D 85/70* (2013.01); *H01F 27/008* (2013.01); *H01F 27/02* (2013.01); *H01F 27/025* (2013.01); *H01F 27/06* (2013.01)

(58) Field of Classification Search

USPC ..... 336/58

See application file for complete search history.

(56) References Cited

U.S. PATENT DOCUMENTS

| | | | | |
|---|---|---|---|---|
| 1,722,149 A | | 7/1929 | Kubler | |
| 3,270,305 A | | 8/1966 | Glassanos | |
| 3,686,561 A | * | 8/1972 | Spreadbury | G05F 3/06 323/308 |
| 4,024,978 A | | 5/1977 | Kiuchi et al. | |
| 4,085,395 A | * | 4/1978 | Billerbeck | H01F 27/06 336/61 |
| 4,453,197 A | | 6/1984 | Burrage | |
| 4,492,314 A | | 1/1985 | Avery | |
| 5,766,517 A | * | 6/1998 | Goedde | H01F 27/12 252/570 |
| 6,050,329 A | | 4/2000 | Durian et al. | |
| 6,568,287 B2 | * | 5/2003 | Golner | G01N 1/14 73/863.71 |
| 2013/0187739 A1 | | 7/2013 | Sullivan et al. | |

FOREIGN PATENT DOCUMENTS

| | | |
|---|---|---|
| EP | 0074521 A1 | 3/1983 |
| GB | 2050069 A | 12/1980 |
| JP | S59150409 A1 | 8/1984 |

OTHER PUBLICATIONS

Ultimate tensile strength.*
English translation of IN201303876.*
International Search Report and Written Opinion, PCT/EP2015/073815, mailed Mar. 3, 2016, ABB Technology AG, 15 pgs.

* cited by examiner

*Primary Examiner* — Ronald Hinson
(74) *Attorney, Agent, or Firm* — Taft Stettinius & Hollister LLP

(57) ABSTRACT

A tank for electrical equipment such as power transformers and shunt reactors has integral stiffeners for reinforcing the tank during overpressure conditions, such as during an arc fault. The stiffeners are formed of a material that is more ductile than the material to which the stiffeners are attached, such as the tank walls and cover. The tank with integral stiffeners allows for expansion of the internal volume of the tank during overpressure conditions, thus, increasing the flexibility of the tank and mitigating the risk of tank rupture.

16 Claims, 7 Drawing Sheets

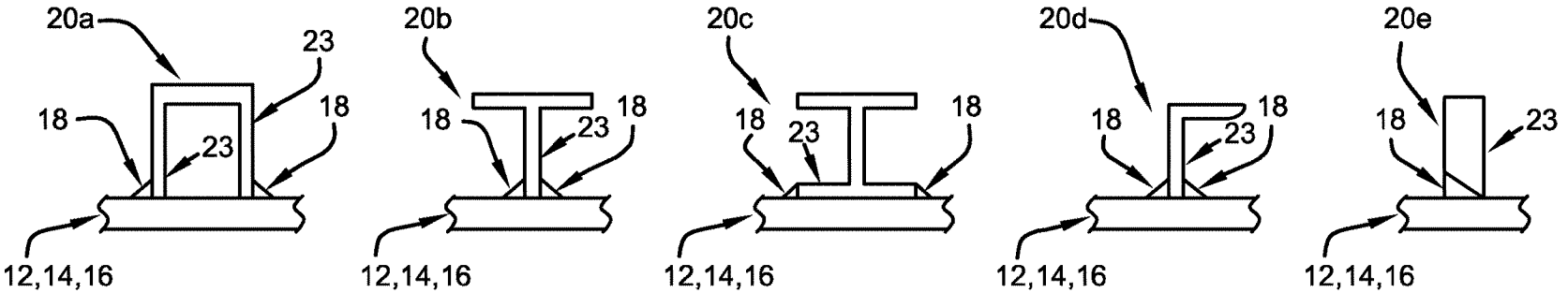
FIG. 2A
FIG. 2B
FIG. 2C
FIG. 2D
FIG. 2E
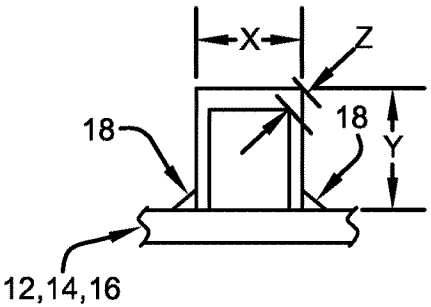
FIG. 2F

TANK FOR ELECTRICAL EQUIPMENT

FIELD OF INVENTION

The present application is directed to a reinforced tank for electrical equipment that is resistant to rupture during overpressure conditions, such as an arc fault.

BACKGROUND

Internal arc energy in electrical equipment such as power transformers and shunt reactors is generated when insulating fluid inside a transformer tank is vaporized and an expanding gas bubble is created. The pressure increase of the expanding gas during an arc fault event can cause the tank to bulge or rupture.

In the case of tank rupture, the seams and welds of the tank separate. In the case of deformation, the tank walls may bulge. In both situations, objects and particles may be expelled forcefully over a sizeable distance causing damage to persons and property. While pressure relief devices and modification of tank dimensions have been utilized with varying degrees of success, there is room for improvement in the design of a tank for electrical equipment that is able to withstand overpressure during an arc fault and thus, resistant to rupture.

BRIEF DESCRIPTION OF THE DRAWINGS

In the accompanying drawings, structural embodiments are illustrated that, together with the detailed description provided below, describe exemplary embodiments of tank for electrical equipment. One of ordinary skill in the art will appreciate that a component may be designed as multiple components or that multiple components may be designed as a single component.

Further, in the accompanying drawings and description that follow, like parts are indicated throughout the drawings and written description with the same reference numerals, respectively. The figures are not drawn to scale and the proportions of certain parts have been exaggerated for convenience of illustration.

FIG. 2A is a perspective view of a U-shaped beam at least one stiffener;

FIG. 2B is a perspective view of a T-shaped beam at least one stiffener;

FIG. 2C is a perspective view of a W-shaped beam at least one stiffener;

FIG. 2D is a perspective view of a L-shaped beam at least one stiffener;

FIG. 2E is a perspective view of a bar at least one stiffener;

FIG. 2F is a perspective view of the x, y, and z dimensions of the at least one stiffener of FIG. 2*a;*

DETAILED DESCRIPTION

Figure 1:
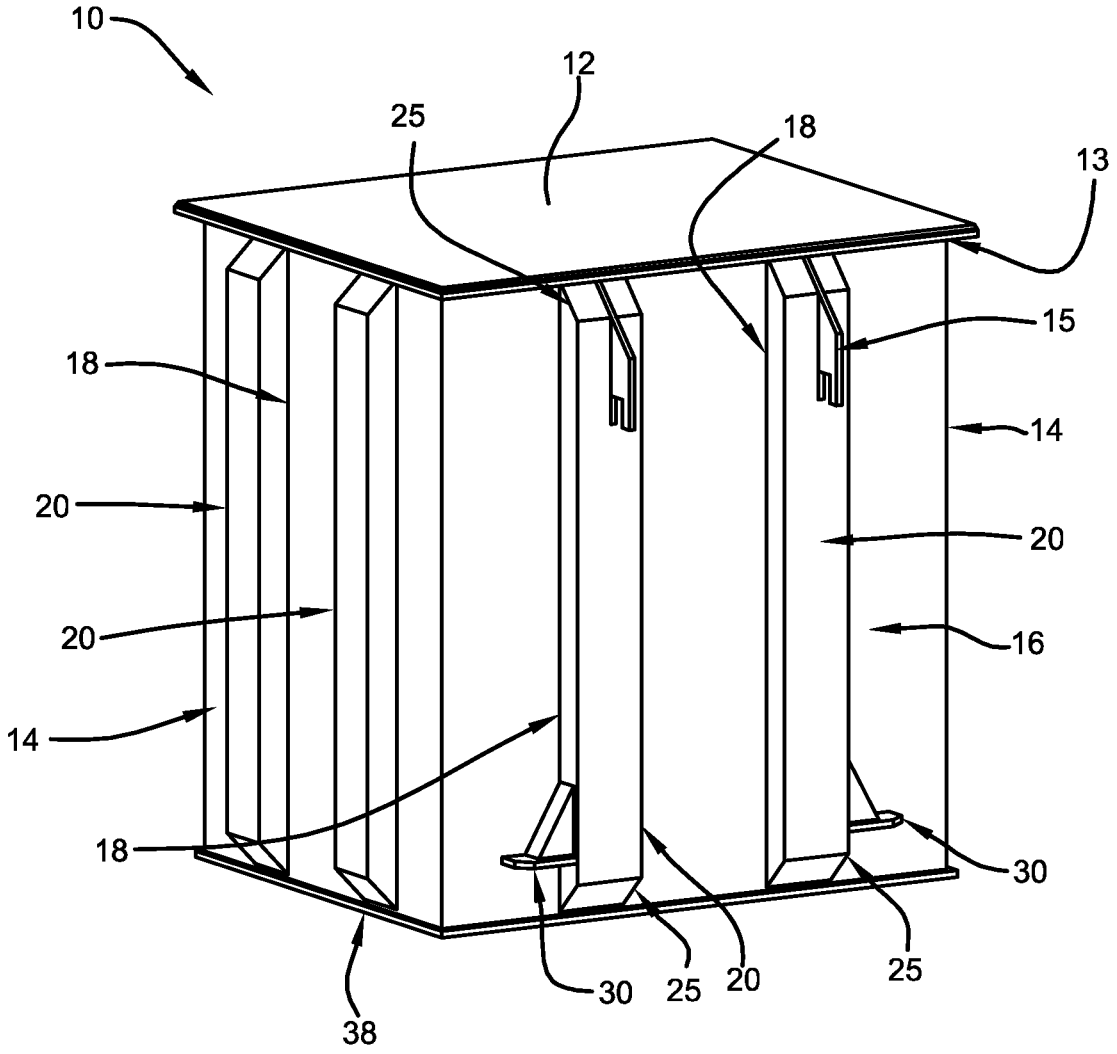
FIG. 1 is a perspective view of a transformer tank that is resistant to rupture and embodied in accordance with the present disclosure.

With reference to FIG. 1 and in accordance with the present disclosure, a tank 10 for electrical equipment, such as power transformers and reactors, has at least one stiffener 20 joined to side walls 14, 16 of the tank 10. The at least one stiffener 20 is joined to the tank 10 side walls 14, 16 and a cover 12 at predetermined positions. The at least one stiffener 20 is joined to the side walls 14, 16 and/or cover 12 at predetermined positions that together with the tank wall 10 dimensions, at least one stiffener 20 dimensions and number of at least one stiffener 20 resist a vacuum service load of −101.3 kPa and an overpressure of at least 69 kPa in the tank 10 without resulting in permanent deformation of the tank 10.

The tank 10 is rectangular, having a bottom wall 38, side walls 14, 16 and a cover 12. Alternatively, the tank 10 is cylindrical, having a single cylindrical side wall, a bottom wall and a cover. The at least one stiffener 20 is a beam, channel member or bar having first and second ends with chamfered surfaces 25. The at least one stiffener 20, when attached to the tank 10, provides reinforcement to the tank 10. The at least one stiffener 20 is joined to the side walls 14, 16 and/or cover 12 by welds 18 between the flanges 23, as shown in FIGS. 2A-2E, and the respective outer surface of the side walls 14, 16. In the case stiffener 20*e*, a chamfered surface may be attached to the respective ones of the side walls 14, 16 and/or cover 12 as depicted in FIG. 2E.

The tank walls 14, 16 and cover 12 are less ductile than the at least one stiffener 20 attached thereto as determined by measured properties, such as values observed during the tensile testing of certain types of mild steel used to form the tank 10 and stainless steel used to form the at least one stiffener 20 in Table 1 presented below. A transformer having a tank 10 with at least one stiffener 20 formed of a material having properties that exhibit a greater ductility than the material used for the tank 10 allows for increased flexibility in the tank 10 in the event of an arc fault. The tank 10 having at least one stiffener 20, when constructed of the materials described below, can withstand the pressure rise during an arc fault by absorbing arc energy generated from inside the tank 10. More particularly, the at least one stiffener 20 absorbs arc energy from the insulating medium when said arc energy is transferred from the internal space of said tank to said stiffeners.

The power transformers 100 and shunt reactors 200 that utilize the tank 10 designs depicted in FIGS. 1, 3, 4, and 7 have a core with at least one limb disposed vertically between a pair of yokes and at least one coil winding mounted to the at least one limb. The core and the at least one coil winding are disposed in an internal volume of the tank 10 along with an insulating medium such as dielectric fluid. In particular, the insulating medium may be mineral oil or another type of oil.

With continued reference to FIG. 1, the tank 10 is formed of sheet metal plates that are welded or bolted together using fasteners. Alternatively, the tank 10 is formed from one single piece of sheet metal by bending the metal to form corners and side walls 14, 16. The tank wall thickness for large and medium power transformers, such as the transformers 100 and shunt reactors 200 described herein, is 5/16 inch (about 7.87 mm), 3/8 inch (about 9.65 mm), 1/2 inch (12.7 mm) or 5/8 inch (about 15.87 mm). The tank walls 14, 16 are fused to the cover 12 at welded interface 13. The cover 12 may be bolted to the tank walls 14, 16 instead of welded. Also shown in FIG. 1 are jacking pads 30 used in conjunction with jacks and lifting points 15 to lift, transport, and slide the tank 10 into place.

The at least one stiffener 20 may be bolted using fasteners rather than connected using welds 18 to the tank walls 14, 16 and/or cover 12. The at least one stiffener 20 is formed of a ductile material such as extra low carbon stainless steel. By way of non-limiting example, a material that can be used to form the at least one stiffener 20 meets the ASTM A240 standard and is. Type 304L. It should be understood that the inventor contemplates that other materials having a ductility that is greater than the ductility of the material used to form the tank 10 walls 14, 16 and cover 12 may be utilized for carrying out the present disclosure and that the examples provided herein are by way of non-limiting example.

Additionally, any of the stainless steels of types and sub-types 304, 316, or 201 are used to form the at least one stiffener 20. Alternatively, super-austenitic stainless steel alloys such as 25-6HN sold under the trademark INCOLOY® and C-276 sold under the trademark INCONEL®, both registered trademarks of Huntington Alloys of Huntington, W. Va., are used to form the at least one stiffener 20.

The types of stainless steel used in the at least one stiffener 20 are austenitic alloys containing chromium and nickel (sometimes manganese and nitrogen), and structured around the Type 302 composition of iron, 18% chromium (weight percent), and 8% nickel (weight percent). Austenitic stainless steel may be annealed, hot-worked or cold-worked.

When the at least one stiffener 20 is welded to the tank 10, the at least one stiffener 20 is integrated with the tank 10. The welds 18 are formed using an American Welding Society (AWS) or a Canadian Standards Association (CSA) standard weld known to persons having ordinary skill in the art. For example, based on the thickness of the tank wall 14, 16 plate, the size of the weld will vary based on AWS and/or CSA standards. Typically, the welds 18 used to attach the at least one stiffener 20 to the side walls 14, 16 and cover 12, respectively, are partial penetration welds. In the case of the side wall 14, 16 and cover 12 interface 13, the weld may be a full or a partial penetration weld 13 depending on the application.

As previously mentioned, at least one stiffener 20 is welded to the corresponding tank walls 14, 16 and/or cover 12 by welding the flanges 23 to the outer surface of the tank walls 14, 16 and/or cover 12. The at least one stiffener 20 may form a gap with respect to the corresponding tank wall 14, 16 or cover 12. Alternatively, the gap may be filled with a material such as sand to change the natural frequency of the at least one stiffener 20 during operation of the power transformer 100 or shunt reactor 200. The at least one stiffener 20, when attached to the tank walls 14, 16 is attached vertically or perpendicularly with respect to the plane of the bottom wall 38 of the tank 10. Alternatively, the at least one stiffener 20 is attached horizontally or parallel with respect to the plane of the bottom wall 38 of the tank 10.

The at least one stiffener 20 provides the tank 10 the advantage of stiffness in elastic strain of the material during service conditions and flexibility in plastic straining during high overpressure. A tank 10 having side walls 14, 16 with at least one stiffener 20 formed from a more ductile material than the side walls 14, 16 increases the arc energy absorbed by plastic deformation to reduce the risk of tank 10 rupture. The overall impact is that the tank 10 with ductile at least one stiffener 20*a* has greater flexibility by reducing the pressure rise gradient as will be explained in further detail below, and thus can contain more arc energy than a tank 10 without the ductility of the at least one stiffener 20.

An example of the material used in the tank side walls 14, 16 and cover 12 is CSA G40.21 grade 50 W steel or another type of mild steel that meets the ASTM A36 standard. Yet another type of material used in the tank walls 14, 16 and cover 12 is a mild steel that meets the A572 standard. Other examples of materials used to form the tank 10 and the at least one stiffener 20, respectively, are presented in Table 1 along with values for the corresponding material properties: yield stress, tensile stress, and elongation percentage at break.

The values for the material properties listed in Table 1 are all minimum values for each particular tensile measurement. A person of ordinary skill in the art will recognize that the possible measured values for each tensile property and material type may be greater than the values listed in Table 1. The mild steel used in the tank 10 and the stainless steel used in the at least one stiffener 20 is in the form of a sheet, strip, plate, beam or flat bar.

In Table 1 below, the 'Usage' column refers to whether the material is used to form the tank 10 or the at least one stiffener 20, the 'General' column refers to the general classification of the material, the 'Material Type' column refers to particular material specifications as defined by ASTM or other standards organizations, 'Yield' refers to the minimum yield stress and is the point at which the material begins to deform plastically, 'Tensile' refers to the maximum stress that a material can withstand while being stretched or pulled before failing or breaking, and 'Elongation' refers to the 'Elongation at Break' expressed as a percentage (%) and is the ratio between initial length and changed length of the specimen at the point of material fracture or deformation.

TABLE 1

| USAGE | GENERAL | MATERIAL TYPE | YIELD | TENSILE | ELONGATION |
|---|---|---|---|---|---|
| Tank Material | Mild steel | Steel CSA G40.21 grade 44 W | 300 MPa | 450 MPa | 21% |
| Tank Material | Mild steel | Steel CSA G40.21 grade 50 W | 350 MPa | 450 MPa | 22% |
| Tank Material | Mild steel | Steel ASTM A572 grade 42 | 290 MPa | 415 MPa | 24% |
| Tank Material | Mild steel | Steel ASTM A36 | 250 MPa | 400 MPa | 23% |
| Tank Material | Mild steel | Steel ASTM A572 grade 50 | 345 MPa | 450 MPa | 21% |
| Stiffener Material | Austenitic stainless steel | Stainless steel ASTM A666 type 316 (Cold-Worked 1/16) | 310 MPa | 585 MPa | 35% |
| Stiffener | Austenitic | Stainless steel ASTM A666 | 205 MPa | 515 MPa | 40% |

TABLE 1-continued

| USAGE | GENERAL | MATERIAL TYPE | YIELD | TENSILE | ELONGATION |
|---|---|---|---|---|---|
| Material | stainless steel | type 316 (Annealed) | | | |
| Stiffener | Austenitic | Stainless steel ASTM A666 | 310 Mpa | 550 MPa | 35% |
| Material | stainless steel | type 304 (Cold-Worked 1/16) | | | |
| Stiffener | Austenitic | Stainless steel ASTM A666 | 205 MPa | 515 MPa | 40% |
| Material | stainless steel | type 304 (Annealed) | | | |

Certain combinations of the above materials for use in forming the tank 10 and at least one stiffener 20 may provide better results than other combinations, according to tests performed by the inventor of the present disclosure. For example, a material used in forming the tank cover 12 and side walls 14, 16 having a yield stress measurement that is equal to or greater than the yield stress measurement of the material used to form the at least one stiffener 20, will result in a tank 10 construction with increased flexibility. In particular, the most flexible tank design using the materials in Table 1 is achieved when the yield stress measurement of the material used to form the side walls 14, 16 is at least 20 MPa greater than the yield stress value of the material used to form the at least one stiffener 20.

Further, the elongation percentage at break for the material used in the at least one stiffener 20 is at least 10% higher than the elongation percentage at break for the material used in forming the tank 10 walls 14, 16 and cover 12, although all of the combinations of stiffener 20 material and tank 10 material that can be made from Table 1 data will allow for the difference in elongation percentage requirement to be met.

In regards to the tensile stress measurement, it is important to note that high strength, low alloy (HSLA) steel does not have the desired elongation at break (%) and tensile stress measured values suitable for usage in the tank 10 or at least one stiffener 20 material. HSLA has a greater tensile stress value coupled with a lower elongation % value at break that renders HSLA not suitable for carrying out the present disclosure. Likewise, using a tank 10 material and stiffener 20 material having measured tensile values that are too similar, may prevent the tank 10 from expanding in response to overpressure. It should also be noted that the tank 10 and at least one stiffener 20 should not both be formed of stainless steel in an above ground installation because that arrangement may not block the magnetic field generated during operation of the power transformer 100 or shunt reactor 200. However, the tank 10 and at least one stiffener 20 may both be formed of stainless steel if the transformer 100 is located in a subsea environment.

The chemical composition of various tank 10 and at least one stiffener 20 materials are provided in Tables 2-9, by way of non-limiting example. The chemical compositions of the various exemplary stainless steels and mild steels are provided in weight percent (weight %) in tables 2-9, based on total weight. 'Min' (Minimum) and 'Max' (Maximum) weight percent values for each element in a composition are provided in tables 2-9. A (-) in the Min column indicates that an element may be present in the compound in trace amounts up to the Max value. A (-) in the Max column indicates that there is no specified Max value for the element in the compound.

TABLE 2

Chemical Composition-Steel CSA G40.21 grade 50 W

| Element | Min | Max |
|---|---|---|
| C | — | 0.23 |
| Mn | 0.5 | 1.5 |
| P | — | 0.04 |
| S | — | 0.05 |
| Si | — | 0.4 |
| Nb + V | — | 0.1 |

TABLE 3

Chemical Composition-Steel CSA G40.21 grade 44 W

| Element | Min | Max |
|---|---|---|
| C | — | 0.22 |
| Mn | 0.5 | 1.5 |
| P | — | 0.04 |
| S | — | 0.05 |
| Si | — | 0.4 |
| Nb + V | — | 0.1 |

TABLE 4

Chemical Composition-Steel ASTM A572 grade 42

| Element | Min | Max |
|---|---|---|
| C | — | 0.21 |
| Mn | — | 1.35 |
| P | — | 0.04 |
| S | — | 0.05 |
| Si | — | 0.4 |
| Cu | 0.2 | — |
| Nb | 0.005 | 0.05 |

TABLE 5

Chemical Composition-Steel ASTM A36

| Element | Min | Max |
|---|---|---|
| C | — | 0.29 |
| Mn | 0.85 | 1.35 |
| P | — | 0.04 |
| S | — | 0.05 |
| Si | — | 0.4 |
| Cu | 0.2 | — |

TABLE 6

| Chemical Composition-Steel ASTM A572 grade 50 | | |
|---|---|---|
| Element | Min | Max |
| C | — | 0.23 |
| Mn | — | 1.35 |
| P | — | 0.04 |
| S | — | 0.05 |
| Si | — | 0.4 |
| Cu | 0.2 | — |
| Nb | 0.005 | 0.05 |

TABLE 7

| Chemical Composition-Stainless steel ASTM A666 type 316 (Cold-Worked or Annealed) | | |
|---|---|---|
| Element | Min | Max |
| C | — | 0.08 |
| Mn | — | 2 |
| P | — | 0.045 |
| S | — | 0.03 |
| Si | — | 0.75 |
| Ni | 10 | 14 |
| Cr | 16 | 18 |
| Mo | 2 | 3 |

TABLE 8

| Chemical Composition-Stainless steel ASTM A666 type 304 (Cold-Worked or Annealed) | | |
|---|---|---|
| Element | Min | Max |
| C | — | 0.08 |
| Mn | — | 2 |
| P | — | 0.045 |
| S | — | 0.03 |
| Si | — | 0.75 |
| Ni | 8 | 10.5 |
| Cr | 18 | 20 |
| N | — | 0.1 |

TABLE 9

| Chemical Composition-Stainless steel ASTM A666 type 304L (Cold-Worked or Annealed) | | |
|---|---|---|
| Element | Min | Max |
| C | — | 0.03 |
| Mn | — | 2 |
| P | — | 0.045 |
| S | — | 0.03 |
| Si | — | 0.75 |
| Ni | 8 | 12 |
| Cr | 18 | 20 |
| N | — | 0.1 |

The mild steel used to construct the tank 10 has the following composition in weight percent based on total weight:

0%≤carbon≤0.29%;
0.5%≤manganese≤1.5%;
0%≤phosphorous≤0.04%;
0%≤sulfur≤0.05%;
0%≤silicon≤0.4%; and the remainder being constituted by iron. Additionally, other elements may be present in trace amounts.

Mild steels of CSA standard G40.20/G40.21 grades 44 W and 50 W have, in addition to the composition by weight percent ranges listed above: 0%≤niobium+vanadium≤0.1%.

Mild steels meeting the ASTM A36 standard, the ASTM standard A572 Grade 42 Type 1 and Grade 50 Type 1 have, in addition to the ranges listed for the elements C, Mn, P, S and Si above, at least 0.2% by weight percent of copper.

In other words, the mild steel used in the side walls 14, 16 and cover 12, in addition to having the elements C, Mn, P, S and Si, includes in its composition a member selected from the group consisting of: 0% niobium+vanadium 0.1% and at least 0.2% percent by weight copper.

Mild steel meeting the ASTM standard A572 Grade 42 Type 1 and Grade 50 Type 1 have, in addition to the ranges listed for the elements C, Mn, P, S, Si and Cu above: 0.005≤niobium≤0.05, percent by weight.

The austenitic stainless steel used in the at least one stiffener 20 has the following composition in weight percent based on total weight:

0.03%≤carbon≤0.08%;
0%≤manganese≤2.0%;
0%≤phosphorous≤0.045%;
0%≤sulfur≤0.03%;
0%≤silicon≤0.75%;
8%≤nickel≤14%;
16%≤chromium≤20%;
0%≤nitrogen≤0.1%; and the remainder being constituted by iron (Fe). It should be understood that any element listed as 0% may be present in trace amounts and that other elements may be present in trace amounts in any of the steel and stainless steel compositions mentioned herein.

It should be noted that in addition to the elements listed in the ranges above, stainless steel ASTM A666 Type 316 also contains molybdenum, expressed in weight percent based on total weight, as follows: 2%≤molybdenum≤3%.

With reference now to FIGS. 2*a*-2*f*, various at least one stiffener 20 geometries are shown. It should be understood that the geometries are presented by way of non-limiting example and that other shapes are contemplated by the inventor. FIGS. 2A and 2F show at least one stiffener 20*a* that is a U-shaped beam such as a U-shaped channel member. The at least one stiffener 20*a* in the form of a U-shaped beam is formed of a material having a thickness (the Z-dimension in FIG. 2F) of 5/16 inch (about 7.87 mm), 3/8 inch (about 9.65 mm), 1/2 inch (12.7 mm) or 5/8 inch (about 15.87 mm).

The at least one stiffener 20*a*, 20*b*, 20*c*, 20*d*, 20*e* is attached to the tank 10 by welding the flanges 23 or sides of the respective stiffeners, along the length of the flanges 23, to the 20*a*, 20*b*, 20*c*, 20*d*, 20*e* to the respective side wall 14, 16 and/or cover 12. The width (the X-dimension in FIG. 2F), height (the Y-dimension in FIG. 2F), thickness, quantity and position of the at least one stiffener 20*a*, 20*b*, 20*c*, 20*d*, 20*e* can be adjusted to optimize the flexibility of the tank 10.

The at least one stiffener 20*a*, 20*b*, 20*c*, 20*d*, 20*e* first and second ends are generally spaced apart from the cover 12 and bottom wall 38, respectively. In some cases, the at least one stiffener 20*a* first and second ends are flush with the cover 12 and bottom wall 38, respectively. Alternatively, the at least one stiffener 20*a*, 20*b*, 20*c*, 20*d*, 20*e* is attached directly to the cover 12 using a cylindrical gusset 32 or a plate gusset 44 as will be described later in reference to FIGS. 7, 7*a*, and 7*b*.

The at least one stiffener 20*a*, 20*b*, 20*c*, 20*d* are metal beams and the at least one stiffener 20*e* is a metal bar. All of the stiffeners have 20*a*, 20*b*, 20*c*, 20*d*, 20*e* first and second ends. At least one of the first and second ends a chamfered edge 25. The chamfered edges 25 of the at least one stiffener 20 are generally positioned proximate to the seam (where two plates used to form the side walls 14, 16 meet) of the tank side wall 14, 16 or cover 12, proximate to the interface 13 between the side walls 14, 16 and cover 12, or proximate to the interface between the side walls 14, 16 and bottom wall 38. It should be understood that number and type of the at least one stiffener 20*a*, 20*b*, 20*c*, 20*d*, 20*e* joined to the side walls 14, 16 and/or cover 12 vary depending on the application.

With continued reference to FIGS. 2B-2E, the at least one stiffener of the types 20*b*, 20*c*, 20*d* have similar thicknesses as the U-shaped stiffener 20*a* and are integrally joined with the corresponding tank wall 14, 16 and/or cover 12 by welds 18 connecting the flanges 23 to the corresponding tank wall 14, 16 and/or cover 12. With reference to FIG. 2B, a T-shaped beam stiffener 20*b* is shown. With reference now to FIG. 2C, a W-shaped beam stiffener 20*c* is shown. With reference now to FIG. 2D an L-shaped beam stiffener 20*d* is shown.

Lastly, FIG. 2E shows a bar stiffener 20*e* that is attached to the corresponding tank wall 14, 16 or cover 12 by a weld 18 or two fillet welds. The bar stiffener 20*e* acts as a brace for the tank wall 14, 16 or cover 12 to which the bar stiffener 20*e* is attached. The bar stiffener 20*e* is formed of a material having a thickness of up to two times thicker than the other types of at least one stiffener 20*a*, 20*b*, 20*c*, 20*d*, and an entire side surface of the bar stiffener 20*e* may be welded to the corresponding tank 10 wall or cover 12, 14, 16, 38 surface. In contrast, the other types of at least one stiffener 20*a*, 20*b*, 20*c*, 20*d* have flanges 23 or portions of the flanges 23 welded to the corresponding outer surface of the side wall or cover 12, 14, 16.

Figure 3:
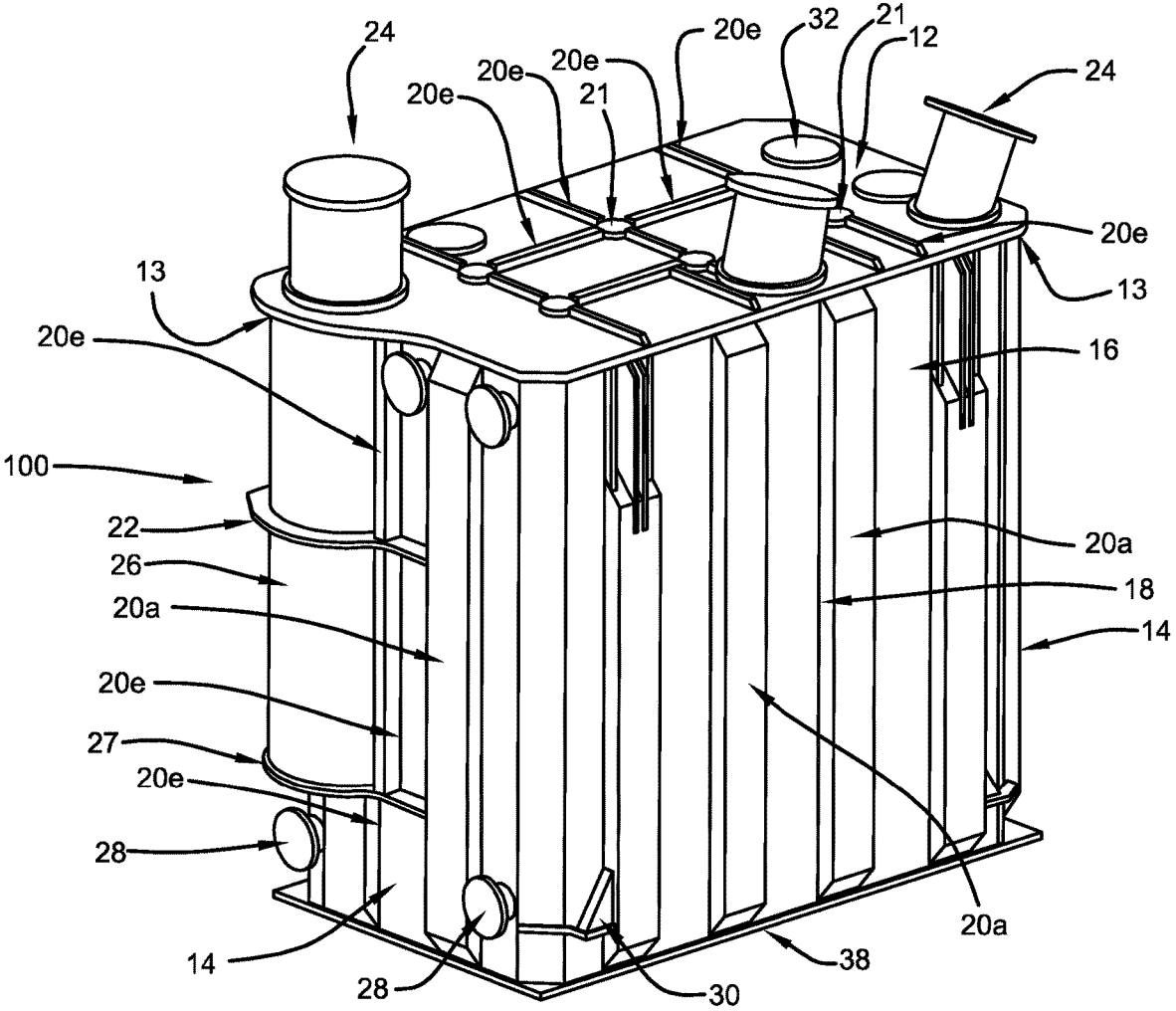
FIG. 3 is a perspective view of an power transformer having a tank that is resistant to rupture.

Referring now to FIG. 3, a power transformer 100 having a 550 MVA and 735/315/12.5 kV rating is shown. The power transformer 100 is a single phase or three-phase autotransformer, having a single winding per phase, unlike the separate and electrically isolated primary and secondary windings of a typical duel-winding transformer. The winding has two end terminals and at least one tap terminal.

In an autotransformer, the primary voltage is applied across two of the terminals and the secondary voltage is taken from two terminals. A first end of the winding is connected to a bushing 24 extending from the cover 12 of the tank 10. It should be understood that while the power transformer 100 example provided is an autotransformer, the mild steel tank 10 having at least one stiffener 20 formed of stainless steel attached thereto, may be applied to any power transformer having dielectric fluid as an insulating medium.

The power transformer 100 has at least one stiffener 20*a*, 20*e* welded to tank walls 14, 16 and the tank cover 12 as shown. The at least one stiffener of the type 20*a* are u-shaped beams that are attached to the outside surface of tank walls 14, 16 by welding the flanges 23 of at least one stiffener 20*a* to the corresponding tank walls 14, 16. One of the at least one stiffener of the type 20*a* is welded to side wall 14 and two of the at least one stiffener of the type 20*a* is welded to the side wall 16.

Each one of the at least one stiffener 20*a* is positioned perpendicularly with respect to the plane of the bottom wall 38. At least one stiffener of the type 20*e* is attached to side wall 14 along with the arcuate stiffener 22 and is used to reinforce the bushing chamber 26 and distribute the stress acting on the bushing chamber 26 to the side walls 14, 16 of the tank 10.

The arcuate stiffener 22 surrounds the circumference of bushing chamber 26 and is welded or otherwise fastened to side wall 14 and the bushing chamber 26. The bushing chamber 26 and thus the arcuate stiffener 22 are shaped so as to reduce space and the amount of insulating fluid inside the power transformer 100. Also, shown on side wall 14 are cooling system connections 28. It should be understood that opposing side walls 16 have the same or similar location and number of at least one stiffener 20*a* and that the opposing side walls 14 have the same or similar location and number of the at least one stiffener of the types 20*a*, 20*e* in the present example, however, that may not be the case in other applications.

Additionally, at least one stiffener 20*e* is attached to the tank cover 12 to reinforce the connection 21 between the cover 12 and the active part of the transformer such as the core and at least one coil winding. FIG. 3 shows twelve of the at least one stiffener 20*e* welded to the cover 12 in a grid pattern. The at least one stiffener 20*e* supports the connection 21 between the cover 12 and active part of the power transformer 100, thus distributing the force experienced by the connection 21 over a larger area, reducing the localized stress on the connection 21 between the active part and the cover 12. The grid pattern of the at least one stiffener of the type 20*e* is formed by welding the chamfered portion of the at least one stiffener proximate to the connection 21. The at least one stiffeners 20*e* may be welded proximate to the connection 21 as shown in FIG. 3, so that three or more of the at least one stiffener 20*e* are proximate to the each connection 21 between the cover 12 and the active part.

It was determined through numerical simulation that during overpressure conditions inside the tank 10, such as greater than 69 kPa, the upward displacement of the cover 12 was too high. Therefore, the at least one stiffener 20*e* were welded to the tank cover 12 to further support and protect the connection 21 between the cover 12 and active part. It should be understood that the arrangement of at least one stiffener of the types 20*a*, 20*e* as depicted in FIGS. 3 and 4 are by way of non-limiting example and that other arrangements are contemplated by the inventor.

The power transformer 100 may also have c-shaped clamps (not shown) to reinforce the side wall 14, 16 seam welds. It should be understood that the c-shaped clamps may also be used to reinforce tank cover 12 welds 13 that fuse the cover with the tank side walls 14, 16 at the outermost edge of the side walls 14, 16 and slightly inward from edges of the cover 12.

Figure 4:
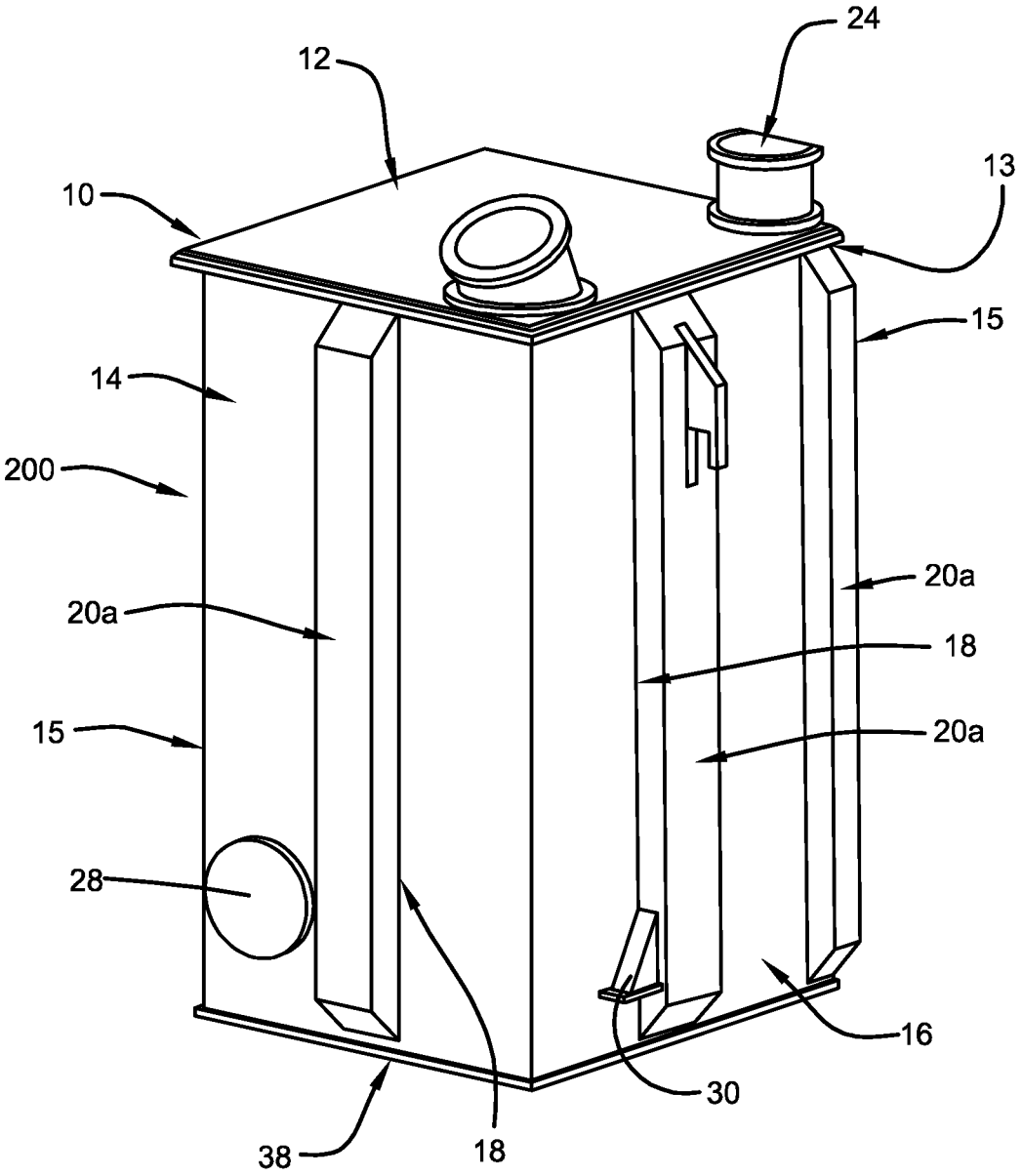
FIG. 4 is a perspective view of a shunt reactor having a tank that is rupture resistant.

With reference now to FIG. 4, a shunt reactor 200 having a 140 MVAr and 315 kV rating is shown. Shunt reactors 200 are used to compensate reactive power and generally have a core with one or more non-magnetic gaps in the at least one limb. The non-magnetic gaps in the at least one limb of the shunt reactor 200 may be filled with an insulating material. There may be a non-magnetic gap in each limb of the core with the non-magnetic gaps positioned inside or outside the corresponding winding mounted to the at least one limb. A first end of the winding is connected to a bushing 24 extending from the cover 12 of the tank 10. The shunt reactor 200 may be single phase or three-phase, depending on the application.

The shunt reactor 200 tank 10 has two of the at least one stiffener 20*a* attached to each of the side walls 16 and at least one stiffener 20*a* attached to each of the side walls 14. In particular, at least one stiffener 20*a* is joined to the edge of the side wall 16 where a seam is formed between side walls 14, 16 and another at least one stiffener 20*a* is joined to the side wall 16 so that an edge of the stiffener 20*a* is aligned proximate to a midpoint of side wall 16. Further, at least one stiffener 20*a* is attached to side wall 14 at a midpoint of side wall 14 and additionally provides reinforcement to manhole 28. It should be understood that in the present example, there are two opposing side walls 14 that are mirror images and two opposing side walls 16 that are mirror images in terms of dimensions and the at least one stiffener 20*a* affixed thereto.

It should be understood that the predetermined position and number of stiffeners may vary depending on the application and desired operating parameters as previously mentioned and that the location and number of stiffeners described herein are provided by way of non-limiting example.

Figure 5:
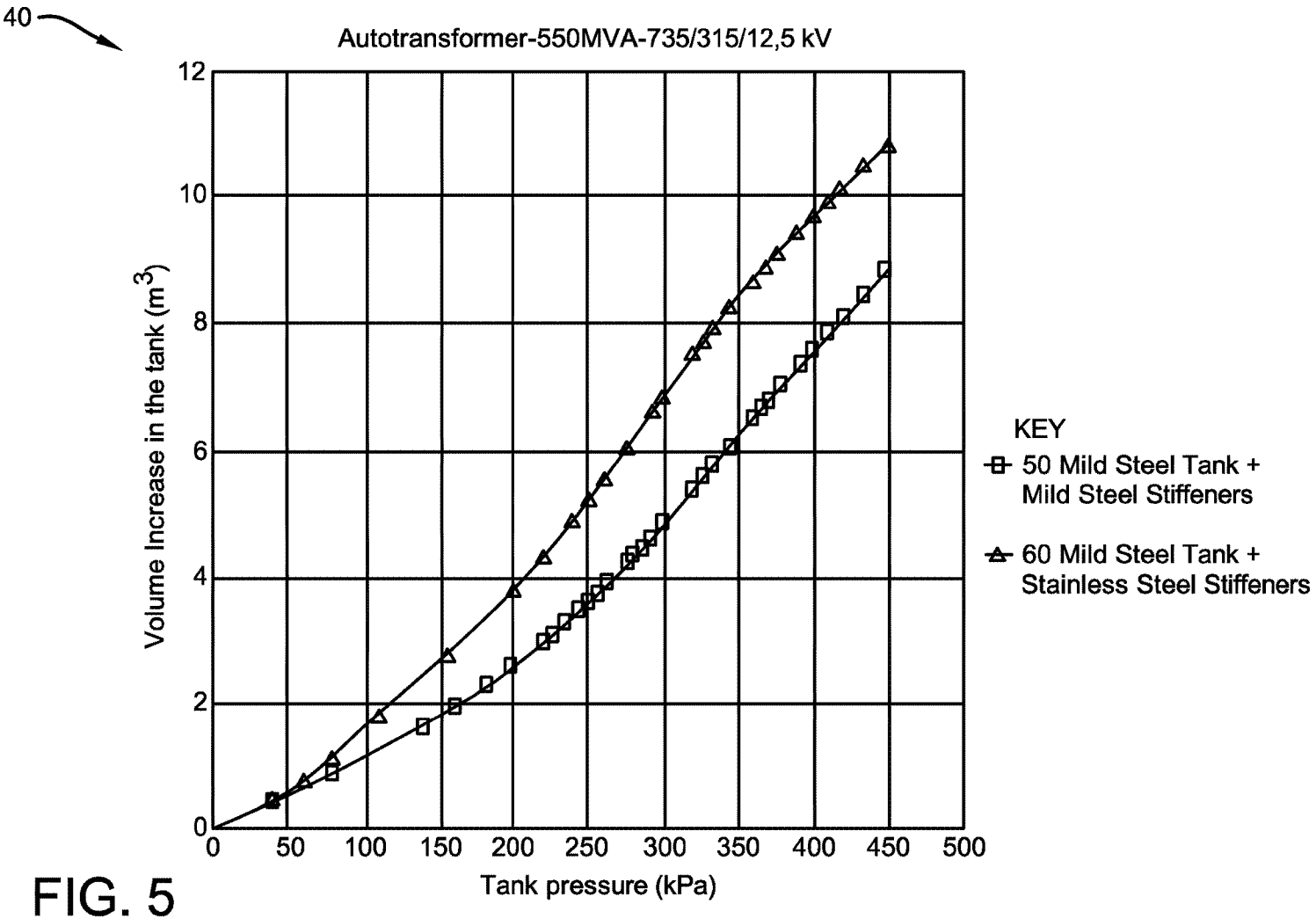
FIG. 5 is a chart depicting tank pressure in kPa (x-axis) versus volume increase in $m^3$ (y-axis) during operation of an autotransformer having a rating of 550 megavolt-ampere (MVA) and 735/315/12.5 kV kilovolts (kV)

With reference now to FIG. 5, a chart 40 depicts the volume increase permitted by a mild steel tank 10 for an autotransformer 100 having at least one stiffener 20 formed of stainless steel joined to a mild steel tank 10 in comparison to the volume increase in a tank formed of mild steel and having mild steel stiffeners 50. The stainless steel of the at least one stiffener 20 allows for the absorption of arc energy exerted on the tank 10 of an autotransformer 100 during an arc fault event.

For example, the overall volume inside the tank 10 is able to increase by about 28% at 400 kPa pressure which is the pressure determined by a numerical simulation software at the point of tank rupture. The 28% increase in volume at 400 kPa allows for gas expansion inside the tank 10 and represents a comparison between the expansion volume (in $m^3$) of a tank formed of mild steel having mild steel stiffeners joined thereto 50 versus a tank formed of mild steel with stainless steel stiffeners joined thereto 60. The arc energy contained by a power transformer 100 having a mild steel tank 10 with at least one stiffener 20 formed of stainless steel joined thereto 60 is at least 11 mega Joules (MJ).

Figure 6:
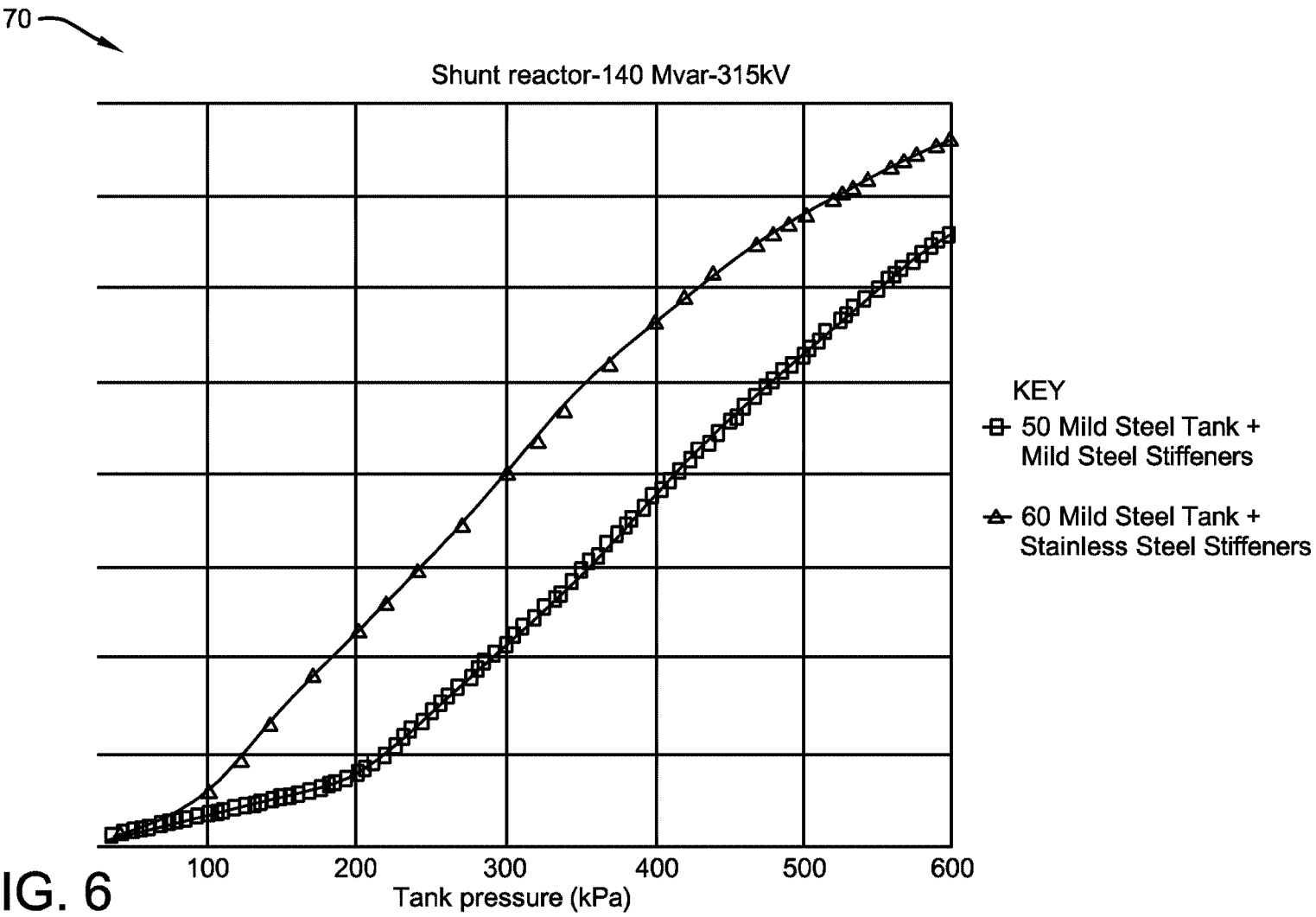
FIG. 6 is a chart depicting tank pressure in kPa (x-axis) versus volume increase in $m^3$ (y-axis) during operation of a shunt reactor having a rating of 140 megavolt-ampere reactive (Mvar) and 315 kV.

With reference now to FIG. 6, a chart 70 showing the pressure in kilopascals (kPa) versus expansion volume in cubic meters ($m^3$) in an internal volume of a shunt reactor 200 tank formed of mild steel 10 having stainless steel stiffeners jointed thereto 60 in comparison to a shunt reactor 200 tank formed having both a mild steel tank and stiffeners 50. The shunt reactor tank 10 of mild steel and having stainless steel at least one stiffener 20 joined thereto 60 permitted the tank 10 to withstand a volume increase of 20% at 520 kPa of tank pressure over a standard mild steel tank 10 having mild steel stiffeners attached thereto 50. 520 kPa is the estimated pressure at the rupture point of a shunt reactor tank using a non-linear structural numerical simulation derived by a software package such as ANSYS mechanical, available from ANSYS, Inc. of Canonsburg, Pa. The arc energy contained by a shunt reactor 200 having a mild steel tank 10 with at least one stiffener 20 formed of stainless steel joined thereto 60 is at least 10 MegaJoules (MJ).

On average, a mild steel tank 10 having the at least one stiffener 20*a* formed of stainless steel attached thereto provides a withstand of thirty percent overpressure in relation to the maximum rated operating pressure for power transformers 100 and shunt reactors 200. FIGS. 5 and 6, depicting an increase in flexibility in the mild steel tank with ductile stainless steel stiffeners 60 over a tank that has stiffeners formed of mild steel 50 were created using a non-linear structural numerical simulation derived by a software package as mentioned above.

The inventor's process of optimizing the tank 10 first accounted for side wall 14, 16 and cover 12 thickness, the at least one stiffener 20 dimensions, position of at least one stiffener 20, and quantity of the at least one stiffener 20 using regular, mild steel for both the at least one stiffener 20 and tank 10 in a numerical simulation as mentioned above. Then, the at least one stiffener 20 material was changed to stainless steel and the numerical simulation was repeated.

Figure 7A:
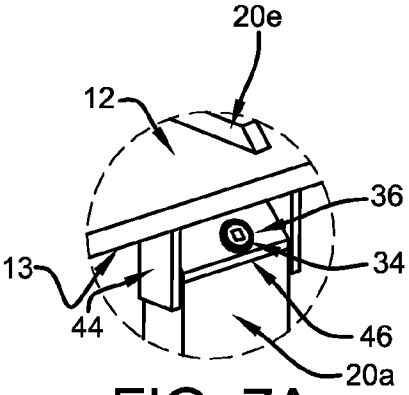
FIG. 7*a* shows plate gussets and their attachment to the at least one stiffener and tank cover in more detail.
Figure 7B:
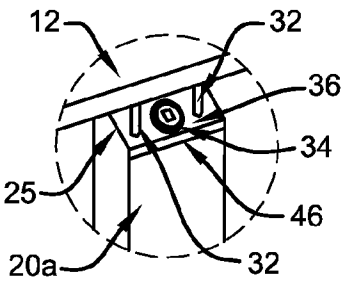
FIG. 7*b* shows cylindrical gussets and their attachment to the at least one stiffener and tank cover in more detail.
Figure 7:
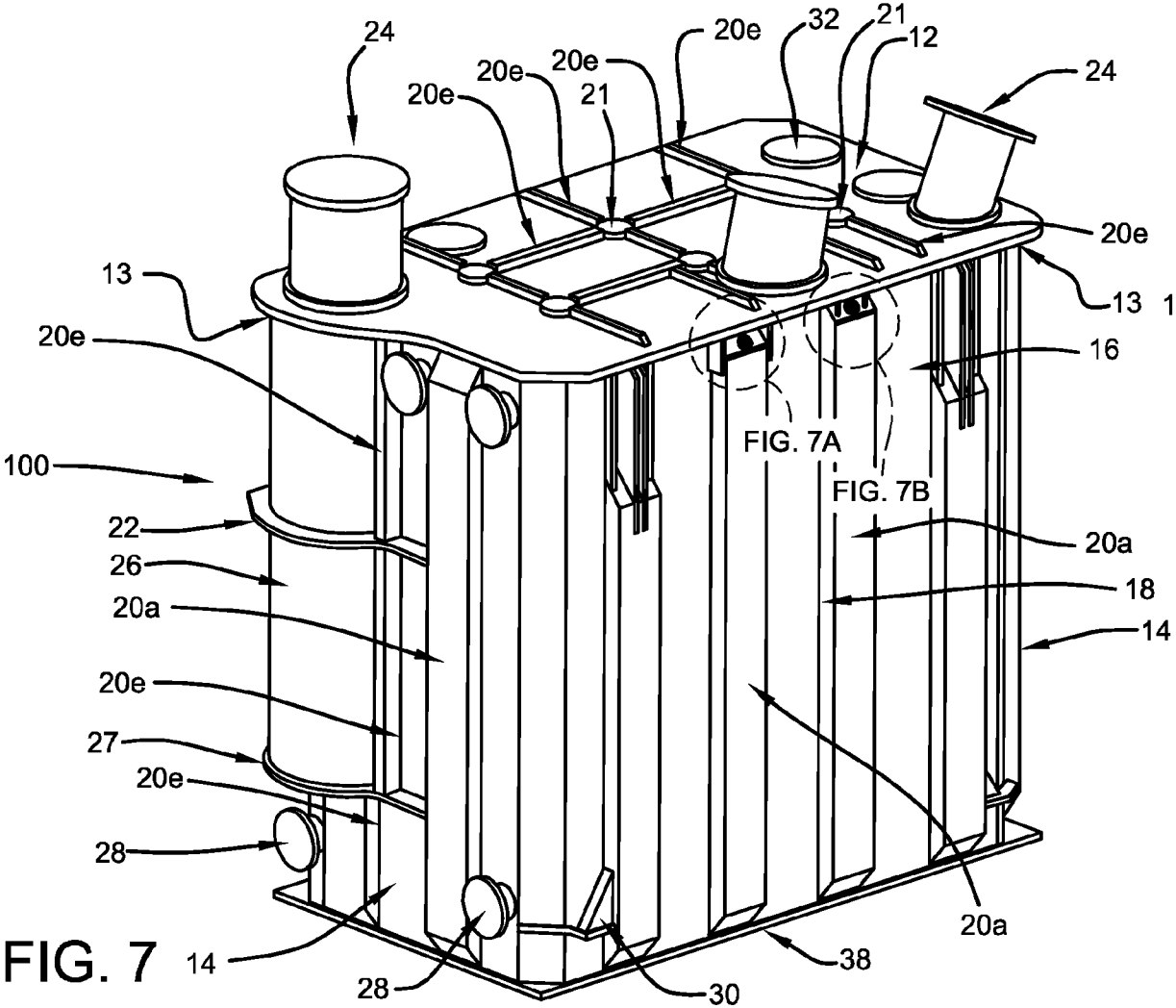
FIG. 7 is the power transformer of FIG. 3 having gussets for bolstering the at least one stiffener and tank.

With reference now to FIGS. 7, 7*a*, and 7*b*, a power transformer 100 having gussets 32, 44 to bolster the tank 10 and at least one stiffener 20*a* are shown. FIG. 7A shows plate gussets 44 having first and second ends, the first end being welded to the cover 12 and the second end being welded to a side surface of the stiffener 20*a*. A cap 36, formed of a metal plate, is welded to the chamfered edges 25 and side edges 46 of the at least one stiffener 20*a*. The at least one stiffener 20*a* may be filled with sand or another material through the plug 34 or prior to the cap 36 being welded to the chamfered edges 25 of the respective at least one stiffener 20*a*. The cap 36 and plug 34 may be formed of steel, stainless steel or brass.

FIG. 7B shows cylindrical gussets 32 having first and second ends, the first end being welded to the tank cover 12 at a first end and welded to the cap 36 at a second end. It should be understood that if gussets are used, typically the same type of gusset 32, 44, either the cylindrical gusset 32 or the plate gusset 44 will be used for the entire tank 10 even though the examples are shown side by side in FIG. 7. Other plate gusset shapes may be utilized, such as triangular or diamond-shaped, depending on the application, and may be attached directly to side walls, 14, 16.

The gussets 32, 44 are formed of steel or stainless steel and distribute localized stress experienced by the side walls 14, 16 and respective cover 13 interface welds or bottom wall interface with the side walls 14, 16. While the gussets 32, 44 are constructed to withstand a vacuum service load of −101.3 kPa and an overpressure of at least 69 kPa experienced by the tank 10, the gussets 32, 44 are designed to deform before the at least one stiffener 20, side walls 14, 16, bottom wall 38 and cover 12 of the tank 10.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application illustrates various embodiments, and while these embodiments have been described in some detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative embodiments, and illustrative examples shown and described. Accordingly, departures may be made from such details without departing from the spirit or scope of the applicant's general inventive concept.

What is claimed is:

1. A tank for a power transformer in an insulating medium, comprising:

a cover, bottom and side walls defining an internal space for receiving the power transformer, said side walls including at least one stiffener joined at predetermined positions to corresponding outer surfaces of said side walls, said at least one stiffener formed of an austenitic stainless steel or mild steel material that has a yield stress value that is lower than or equal to the yield stress value of the material used to form the side walls, said at least one stiffener absorbing arc energy from the insulating medium, wherein said at least one stiffener is formed of an austenitic stainless steel having a chemical composition comprising by weight:

0.03%≤carbon≤0.08%;
0%≤manganese≤2.0%;
0%≤phosphorous≤0.045%;
0%≤sulfur≤0.03%;
0%≤silicon≤0.75%;
8%≤nickel≤14%;
16%≤chromium≤20%;
0%≤molybdenum≤3%;
0%≤nitrogen≤0.1%; and
the remainder being constituted by iron.

2. The tank of claim 1 wherein said stiffeners are joined to said side walls and positioned perpendicularly with respect to a plane of said bottom wall.

3. The tank of claim 1 wherein said stiffeners are joined to said cover and positioned horizontally with respect to a plane of said bottom wall.

4. The tank of claim 1 wherein said cover has said at least one stiffener welded thereto.

5. The tank of claim 1 wherein the stiffener material yield stress value is at least 20 MPa less than the yield stress value of the material used to form said side walls.

6. The tank of claim 1 wherein said stiffener material has an elongation % at break value that is at least ten percent higher than the material used to form said side walls.

7. The tank of claim 4 wherein said at least one stiffener welded to said cover includes a plurality of stiffeners arranged in a grid pattern said stiffeners for reinforcing the connection between said cover and an active part of said transformer.

8. The tank of claim 1 wherein a bushing extends from said cover.

9. A tank for electrical equipment, comprising:

a bottom wall, side walls, and a cover, said cover joined to said side walls; and a plurality of stiffeners attached at predetermined positions to corresponding outer surfaces of said side walls, said stiffeners formed from an austenitic stainless steel or mild steel material having a measured yield stress value that is lower than or equal to the measured yield stress value of the material used to form the side walls, wherein said stiffeners are formed of an austenitic stainless steel having a chemical composition comprising by weight:

0.03%≤carbon≤0.08%;
0%≤manganese≤2.0%;
0%≤phosphorous≤0.045%;
0%≤sulfur≤0.03%;
0%≤silicon≤0.75%;
8%≤nickel≤14%;
16%≤chromium≤20%;
0%≤molybdenum≤3%;
0%≤nitrogen≤0.1%; and
the remainder being constituted by iron.

10. The tank of claim 9 wherein said stiffeners are joined to said side walls and positioned perpendicularly with respect to a plane of said bottom wall.

11. The tank of claim 9 wherein said stiffeners are joined to said cover and positioned horizontally with respect to a plane of said bottom wall.

12. The tank of claim 10 wherein the stiffener material yield stress value is at least 20 MPa less than the yield stress value of the material used to form said side walls.

13. The tank of claim 9 wherein said cover has at least one of said stiffeners welded thereto.

14. The tank of claim 9 wherein said stiffener material has an elongation % at break value that is at least ten percent higher than the material used to form said side walls.

15. The tank of claim 9 wherein said stiffeners are formed of an austenitic stainless steel additionally comprising, in weight percent: 2%≤molybdenum≤3%.

16. The tank of claim 9 wherein said walls of said tank are formed of a mild steel having a chemical composition comprising by weight:

0%≤carbon≤0.29%;
0.5%≤manganese≤1.5%;
0%≤phosphorous≤0.04%;
0%≤sulfur≤0.05%;
0%≤silicon≤0.4%;
a member selected from the group consisting of: 0%≤niobium+vanadium≤0.1% and at least 0.2% percent by weight copper; and
the remainder being constituted by iron.

* * * * *